United States Patent [19]

Petersen

[11] 4,261,281

[45] Apr. 14, 1981

[54] MARINE ANCHOR

[75] Inventor: Larry C. Petersen, Marysville, Wash.

[73] Assignee: Petersen Machine Works, Inc., Seattle, Wash.

[21] Appl. No.: 24,893

[22] Filed: Mar. 29, 1979

[51] Int. Cl.[3] ..... B63B 21/44

[52] U.S. Cl. ..... 114/304

[58] Field of Search ..... 114/294, 297, 298, 299, 114/301, 304, 305, 307, 308, 309, 310

[56] References Cited

U.S. PATENT DOCUMENTS

| | | | |
|---|---|---|---|
| 481,782 | 8/1892 | Chrietzberg | 114/310 |
| 713,825 | 11/1902 | Wick | 114/308 |
| 2,563,380 | 8/1951 | Staempfli | 114/298 |
| 2,643,631 | 6/1953 | Danforth | 114/309 |
| 2,789,526 | 4/1957 | Gollner | 114/298 |
| 2,870,731 | 1/1959 | Marshburn et al. | 114/298 |
| 3,762,357 | 10/1973 | Ehrhardt | 114/298 |

FOREIGN PATENT DOCUMENTS

| | | | |
|---|---|---|---|
| 1145047 | 3/1963 | Fed. Rep. of Germany | 114/304 |
| 150024 | 3/1973 | U.S.S.R. | 114/304 |
| 556991 | 9/1977 | U.S.S.R. | 114/304 |

*Primary Examiner*—Duane A. Reger
*Attorney, Agent, or Firm*—Dowrey & Cross

[57] ABSTRACT

A stockless marine anchor having multiple-pointed twin flukes balanced symmetrically about and secured to a shaft having a shank means connected thereto for moving the flukes into anchoring position and means for releasing the flukes from the anchoring position. In one embodiment, two releasing rings are provided, one on each fluke, and the shank means is mounted for limited rotation on the fluke shaft. In a second embodiment, a spring-biased plunger enclosed within the shank releases the shank for rotation on the fluke shaft.

20 Claims, 7 Drawing Figures

MARINE ANCHOR

BACKGROUND OF THE INVENTION

1. Field of Invention

This invention relates to marine anchors and more particularly to twin fluke stockless anchors and with greater particularity to twin fluke stockless anchors with release devices.

2. Description of the prior art

For general purposes of classification and to clarify the present invention, anchors can be divided into two basic groups: those requiring a stock, and those not requiring a stock. Some stockless anchors include the plow anchor, the wishbone, the mushroom and the stockless or patent anchor. Stockless anchors do not require a stock because they are constructed so that even balance is produced when an anchoring pull is applied. The stock anchors include the kedge anchor and the pivoted stock twin fluke anchor. The stock is required for stability because such anchors become extremely unbalanced and tip when an anchoring pull is applied. The stock is a bar which extends outwards beyond both sides of the anchor to provide stability. Many anchors of both types have been made and used, but are generally inefficient with respect to initial engagement with the sea bottom and holding power per area and shape of fluke. The stock anchors have an added disadvantage in that they are extra wide, making them awkward to handle. The stock during anchoring engagement may hit obstacles on the bottom, causing the anchor to bounce and jump, thus preventing engagement with the bottom. The stock when anchoring will usually drag one end, causing the anchor to tip up on its side. In this position, the stock digging into the bottom will keep the anchor up on its side, preventing solid holding power. The anchors described are extremely difficult to remove when they become locked into the bottom or caught under obstacles and many are never retrieved.

Rotatable releasing anchors can be of various types, but all come under the general classification of releasing twin fluke type. Some of these anchors have an extra line which is used for releasing the fluke shaft. This arrangement is unsatisfactory because it can be easily entangled. Additionally, this type will not reset. Some of these anchors are designed to release the fluke shaft with the line used for mooring. By dragging the anchor in the opposite direction from that used to set the anchor, rotating fins roll the flukes over and the anchor resets. The rolling anchors that reset have three major drawbacks:

1. They are complicated and expensive to manufacture and market.
2. They are mechanically impractical for the sea bottom environment, because they are easily jammed or made inoperable by rocks, coral, sticks, mud and debris.
3. They do not have flukes designed for balance, stability, quick positive engagement and penetration with the bottom.

SUMMARY OF THE INVENTION

The present invention comprises an improved rotatable releasing anchor, having two flukes, wherein each fluke is of a balanced multiple point type. These flukes provide for a balanced and stable anchor and eliminate the need for a stock. They also greatly increase the effective holding power and speed of penetration of the anchor. One embodiment of this invention further comprises adding releasing rings to the flukes to provide a release means.

The two releasing rings give an added stability during fluke engagement with the sea bottom and provide a means for removing the anchor. When the boat is positioned directly over the anchor and an upward pull on the line is applied, the shank driving upward impacting the shank stop will rotate the anchor on the releasing rings, causing the flukes to turn upward and free the anchor from the bottom. If the anchor becomes lodged under a heavy obstacle, the boat is then positioned to the rear of the anchor with plenty of line out and then when a pull on line is applied, the anchor will move backwards against the reversing rings and slide out and upward from under an obstacle.

A second embodiment of the anchor employs a locking release mechanism as a release means.

This embodiment also incorporates a twin shank boss to add strength, bearing surfaces for shaft and a housing for pins to protect the locking mechanism from debris. Some components of the improved anchor are of identical size and shape so that manufacture is simplified. The completely enclosed locking mechanism made possible by the twin shank, twin boss, plunger tube, link guide end cap and connecting link provide for a rugged and dependable releasing anchor which is not easily damaged.

The objects, characteristics, and advantages of this invention will be apparent and more readily understood upon consideration of the following detailed description, when taken in connection with the accompanying drawings.

DETAILED DESCRIPTION OF THE DRAWINGS

Figure 1:
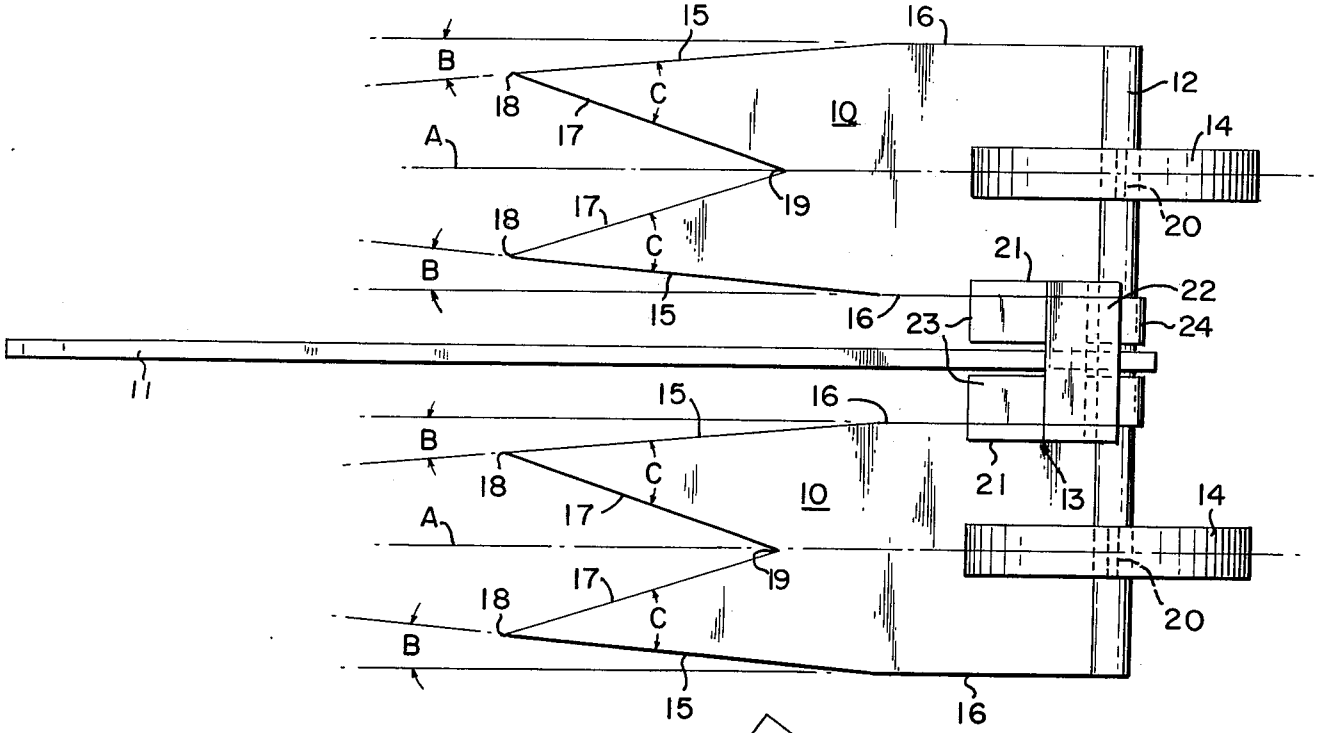
FIG. 1 is a top plan view of anchor in a neutral position.
Figure 2:
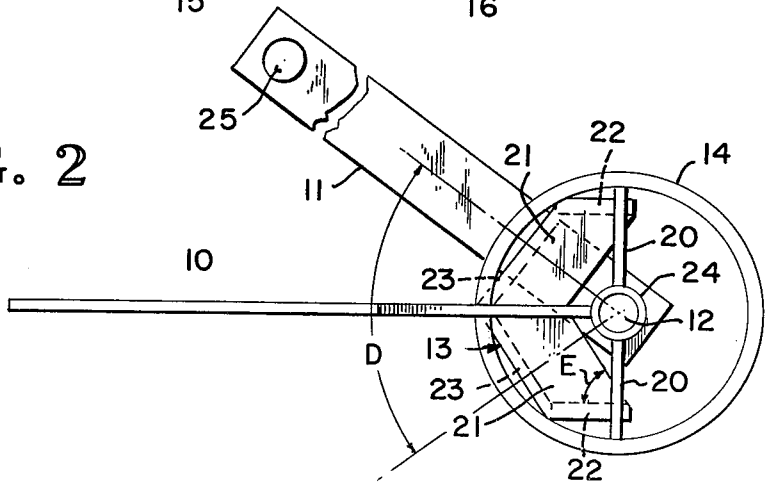
FIG. 2 is a side elevation of the anchor in an anchoring ready position.
Figure 3:
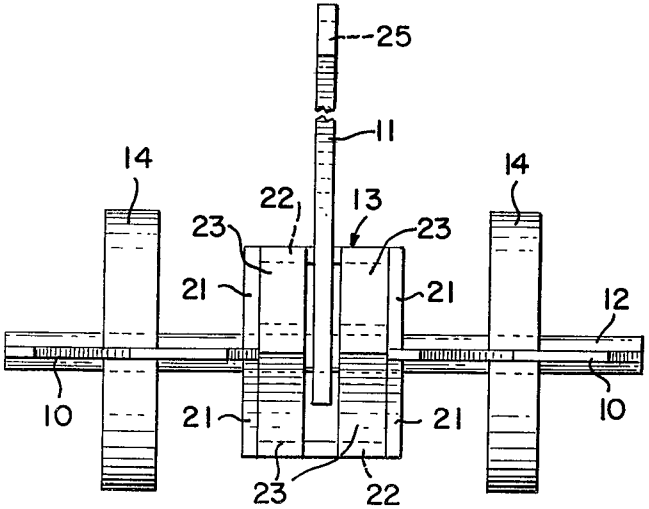
FIG. 3 is a front view of the anchor in an anchoring ready position.

The anchor shown in FIGS. 1–3 comprises a shank 11 with a hole 25 at its forward end for attachment of an anchor line and a hole at its rearward end to accept fluke shaft 12, to which are welded or otherwise rigidly attached two multiple point flukes 10. Shank 11 is pivoted from fluke shaft 12 with shank stop unit 13, guiding, centering and stopping travel of shank 11. Flukes 10 are given added strength against spreading and bending by being attached solidly into shank stop unit 13. As a release means two release rings 14, are rigidly attached to flukes 10, to provide for additional leverage when force is applied to shank 11 for anchor removal. Flukes 10 are given the proper engagement angle by having their rearward end raised by the release rings 14.

The multiple point flukes 10 are identical in shape and size, allowing them to be used on either side of the anchor. They may be made of high strength steel plate, at a low cost by conventional methods. The rearward outer edges 16 of fluke 10 run parallel to shank 11, for approximately one-half or less of the length of fluke 10. The best results are obtained by making the length of edges 16 the same as the width of fluke 10. The forward outer edges 15 of fluke 10 make angle B with the continuation of rearward outer edge 16. The preferred angle B for edge 15 is approximately 5 degrees, a range of 3 degrees to 8 degrees being satisfactory allowing balanced penetration. The two points 18 of each fluke 10 should be equidistant from center line A—A of the fluke, and each point 18 should be equidistant from fluke shaft 12. Inner edges 17 should terminate at a common point 19, with angle C between edges 15 and edges 17 being preferably 20 to 30 degrees, with 24 degrees providing the best penetration angle. The above outline for designing anchor flukes 10 has proved to be the best for quick balanced stabilized engagement and penetration of the bottom, by preventing floating, skidding, rolling and tilting. This type of anchor fluke 10 has no need for an awkward stock, and has much higher holding power per fluke area and size.

Anchor releasing rings 14 may be cut from a piece of pipe or rolled from a flat piece of metal. Rings 14 are secured to anchor flukes 10, and may be strengthened by support 20. The preferred position for releasing rings 14 is to be concentric to fluke shaft 12 centered along fluke center line A—A. This placement provides added balance and a proper fluke engagement angle. When an upward recovery pull is applied to shank 11, the releasing force is transmitted to release rings 14, causing an upward rotation which frees flukes 10. If the anchor is over ridden for recovery, release rings 14 prevent the anchor from catching in the bottom, and provide a sliding, rearward and upward lifting action that will release the anchor.

Anchor shank stop unit 13 may be comprised of a combination of three sizes of cut bar stock, used in multiples and constructed and attached to flukes 10, forming complete unit 13. Four side supports 21 are attached to fluke 10 parallel and adjacent two inner edges 16. Adjacent the outer edges of side supports 21, two stop plates 22 are attached between the opposing supports 21. The lifting releasing force and anchor fluke engagement angle is determined by the spacing of flukes 10 and stop plates 22.

Side supports 21, may be made from bar stock at an angle E which is preferably 55 degrees to keep stop plates 22 in a parallel plane with anchor flukes 10. Side supports 21 are of a length such as to allow shank 11 to pivot to an angle of 35 degrees from the side of fluke 10, the total pivot angle D is thus preferably 70 degrees. A total pivot angle D of 60 degrees to 90 degrees is satisfactory, but 70 degrees has been found to be the preferred angle for quick and deep penetration. Attached to the forward edge of side supports 21, are four shank guides 23, which center shank 11 at their forward edge. Two guide rings 24 are attached to fluke shaft 12 in order to center the rear of shank 11. Shank guide 23 keeps rocks and debris from entering anchor shank stop unit 13, during forward motion of anchor in the bottom. When shank 11 moves against stop plate 22, the pivoting action cleans the interior of anchor shank stop unit 13, by sliding debris out the open and back thus producing a non-plugging, dependable and non-jamming anchor. The low profile and rearward sloping angle E of anchor side supports 21 and forward sloping shank guides 23 cause bottom debris to diverge around anchor to avoid fouling.

Another embodiment of the anchor with an alternate release means is shown in FIGS. 4–7.

Figure 4:
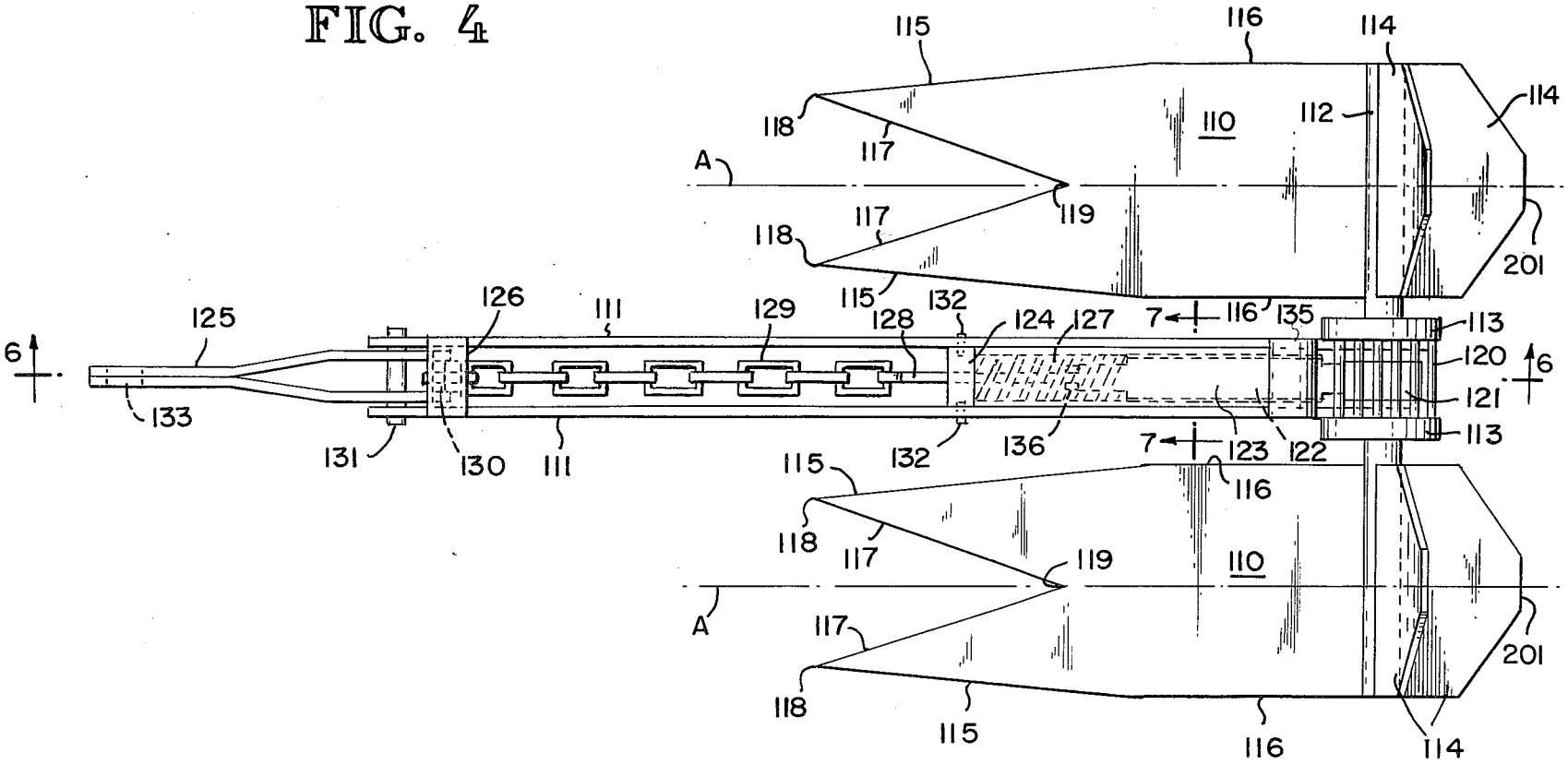
FIG. 4 is a top plan view of another embodiment of the anchor in a neutral position.

FIG. 4 shows twin shanks 111 having holes at one end for accepting pin 131 which attaches release lever 125. Release lever 125 has a hole 133 at one end for attachment of an anchoring line and attaches at the other end to the release mechanism. Two release lever stops 126 limit movement of the release mechanism. The other end of shanks 111 have holes for accepting fluke shaft 112. Fluke shaft 112 has flukes 110 and fluke rotators 114 attached. Also attached to fluke shaft 112 is the release mechanism. The structure of flukes 110 is as described in the description of FIGS. 1–3. Fluke rotators 114 and flukes 110 are centered on line A—A to provide stability and balance. Fluke rotator contact points 201 are preferably 1/5 to ¼ of the rotator width to provide a firm and positive contact with the sea bed to make rotation quick and dependable. Shank bosses 113 attached to shanks 111 are circular plates with holes providing bearing surfaces for fluke shaft 112. A series of cage pins 120 are attached between the shank bosses 113 to prevent debris from entering the release mechanism. Pins 120 are spaced at intervals sufficient to allow water and sand to pass through but prevent entry of any item large enough to jam the mechanism. Attached to the center of fluke shaft 112 is cam 121 which forms part of the release mechanism. Between shanks 111 is attached plunger guide 123. Plunger guide 123 extends from a point just forward of shank bosses 113 for about ⅓ the length of shanks 111. At the end of plunger guide 123 away from shaft 112 are two set screws 132 which attach cap guide 124 which seals the end of plunger guide 123. Cap guide 124 also has a hole which guides the movement of releasing link 128. A skid bar 135 is attached between shanks 111 to prevent damage to cage pins 120 and add strength to plunger guide 123. Link connectors 129 connect to releasing link 128 and releasing pin 130 which is connected to releasing lever 125.

Figure 5:
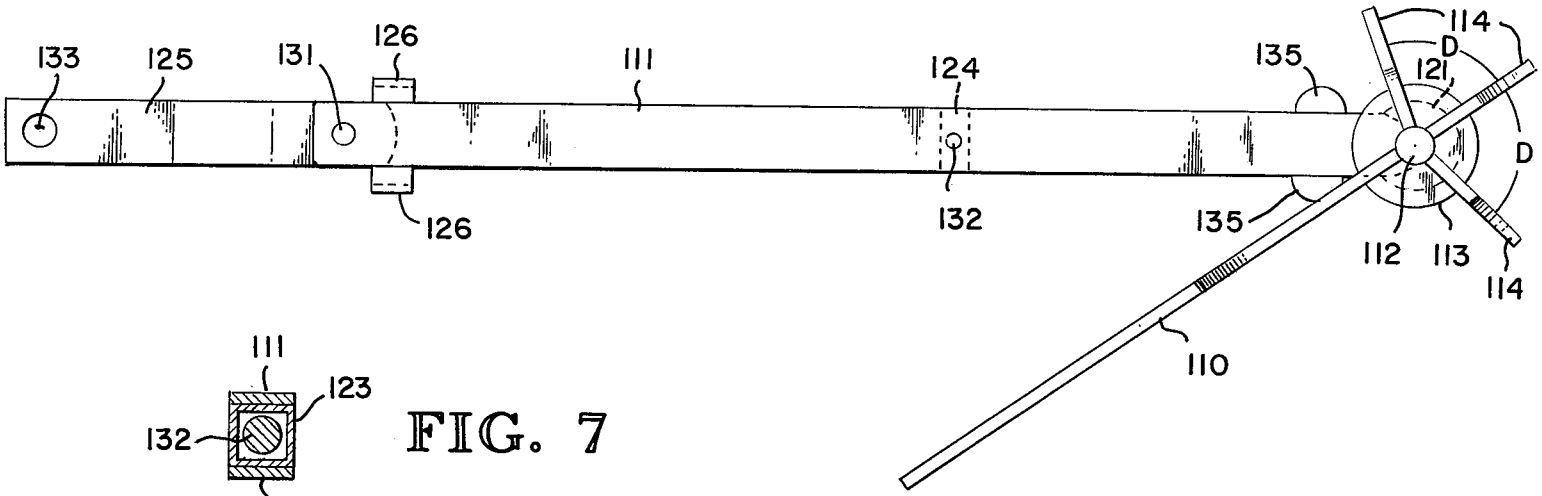
FIG. 5 is a side elevation of the FIG. 4 anchor in anchoring position.

FIG. 5 is a side view of the anchor of FIG. 4. It is apparent that flukes 110 and rotators 114 radiate from shaft 112. Fluke rotators are spaced at angle D from the middle rotator which is coplanar with flukes 110. Angle D is satisfactory if between 45 and 90 degrees. The preferred angle D is 75° to provide superior rotation.

Figure 6:
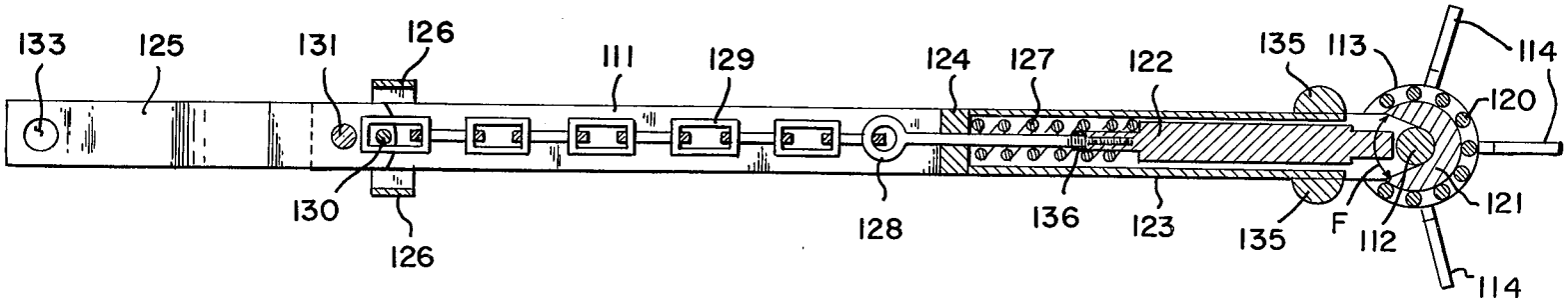
FIG. 6 is a cross-sectional view taken along line 6—6 of FIG. 4.

FIG. 6 is a sectional view along line 6—6 of FIG. 4 to show the release mechanism.

Release lever 125 may be cut, bent, and welded from flat bar stock into the shape of a Y with the stem being at the forward end with a hole 133 to allow for hook up with anchor line. The rearward end of release lever 125 is spread out so that each side slips into and against the inner sides of twin shanks 111. The extreme rearward end of release lever 125 is drilled to allow for acceptance of release pin 130, which may be riveted into release lever 125 and connected to link connectors 129. Another hole is provided just forward of pin 130, to allow for acceptance of pivot pin 131, thus allowing release lever 125 to pivot in-between twin shanks 111. Release lever 125 thus provides leverage in a ratio of approximately 7 to 1, which is needed to transmit anchor line override pull into lock plunger 122 disengagement movement. Release stops 126 may be a U shaped strip of flat steel which is attached to twin shanks 111 just rearward of release lever pivot pin 131. When release lever 125 is moved to an angle of 90 degrees with twin shank 111 in either direction, further movement will be stopped by the release stop 126. Strain and damage to lock plunger 122, plunger springs 127, releasing link 128, link connectors 129 and release pin 130 is thus prevented. Link connectors 129 are preferably made from galvanized chain links to prevent jamming. Being flexible, link connectors 129 provide a smooth and dependable releasing and locking action for the anchor. Releasing link 128 provides spring tension adjustment and lock plunger 122 travel adjustment by means of nut 136. Nut 136 also locks releasing link 128 and lock plunger 122 together.

The lock plunger 122 may be made from stainless steel or steel shafting that has been galvanized. The rearward end or engagement end of lock plunger 122 is a diameter that is the same as fluke shaft 112; this allows it to engage lock cam 121 to provide the proper anchor engagement angle. On the forward end of lock plunger 122, a shoulder is provided for a stainless steel plunger spring 127 to seat against. Spring 127 provides pressure causing lock plunger 122 to remain engaged with lock cam 121 during anchoring. Lock plunger 122, being cylindrical in shape, allows rotation for adjustment. Releasing link 128 is preferably of stainless steel to prevent corrosion and may be threaded at one end to allow fitting to lock plunger 122. End cap guide 124 provides for a spring retainer and stop for plunger spring 127, causing plunger spring 127 to exert spring pressure and move lock plunger 122 rearwardly into lock cam 121. The lock cam 121 may be high strength steel plate. Lock cam 121 is attached onto fluke shaft 112. One wide lock cam 121 is used for engagement with lock plunger 122. The notched cut in lock cam 121 for engagement with lock plunger 122 is at an angle F preferably of about 70 degrees which provides a proper anchoring fluke angle. Angle F may range from 60 degrees to 90 degrees with satisfactory functional anchoring attained, but 70 degrees is preferable and most dependable. The backside of lock cam 121 is cylindrical allowing lock plunger 122 when in released position to ride around back side of cam lock 121 and drop into the notch and lock anchor for anchoring in the opposite direction. Cam lock 121 is non jamming or fouling because the notch in lock cam 121 is open on the sides. Spring pressure from plunger 122 pushes sand and mud out of the way to provide for a positive and solid locking action.

Figure 7:
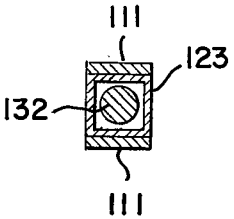
FIG. 7 is a cross-sectional view taken along line 7—7 of FIG. 4.

FIG. 7, a sectional view between 7—7 of FIG. 4 shows plunger guide 123 between twin shanks 111. Guide 123 determines shanks 111 spacing and adds strength to shanks 111. The plunger guide 123 may be cut from a piece of square steel tubing. The square construction of plunger guide 123 is preferable when used with a round lock plunger 122, because sand and grit will not sieze the mechanism. Plunger guide 123 guides lock plunger 122 in and out of engagement with lock cam 121 and protects lock plunger 122 and plunger spring 127 from debris and damage, providing a dependable and free working release mechanism.

In operation the anchor of this embodiment is set as a conventional pivoted twin fluke anchor. When it is desired to release the anchor, tension on the anchor line is transmitted by the release lever, 125, link connectors 129 and release link 128 causing plunger 122 to withdraw from the notch in cam 121. The flukes 110 and rotators 114 are able to rotate and thus disengage from the bottom. Conventional fabrication methods may be used throughout and welding has been found suitable in most metal parts.

While the invention has been described in terms of two specific embodiments thereof, it will be appreciated that other forms could be adapted by one skilled in the art and, accordingly the invention is to be considered limited only by the scope of the following claims.

I claim:

1. A marine anchor comprising;

a fluke shaft, a pair of flukes secured in spaced relation at their rear edges to said shaft, and shank means operatively connected to said shaft for moving said flukes into anchoring position;

each said fluke being balanced symmetrically about its centerline which extends normal to said fluke shaft and including a plurality of engaging points on the forward edge thereof, the forward portions of the outer side edges of each fluke being inclined toward the fluke centerline at an angle of from 3 to 8 degrees.

2. The marine anchor according to claim 1, wherein; the distance along the rearward portion of the outer side edge from the point at which the incline begins to the point of attachment of each fluke to the fluke shaft is approximately equal to the width of the fluke.

3. The marine anchor according to claim 1, wherein; the angle of inclination is approximately 5 degrees.

4. The marine anchor according to claim 1, wherein; the angle between the forward portion of the side edges and the edge formed by a line extending from each point to the centerline is from 20 to 30 degrees.

5. The marine anchor according to claim 1, wherein; the angle between the forward portion of the side edges and the edge formed by a line extending from each point to the centerline is 24 degrees.

6. The marine anchor according to claim 1 wherein; said shank means is rotatably connected to said fluke shaft, and fluke rotating means associated with each said fluke and said fluke shaft for releasing said flukes from anchoring engagement with a rearward and lifting motion upon rotation.

7. The marine anchor according to claim 1, wherein; said shank means is rotatably connected to said fluke shaft, and rotation limiting means operatively associated with said shank means and said fluke shaft for limiting the relative rotation therebetween, whereby said flukes may be moved into engaging position by force applied to said shank means along its longitudinal axis and said flukes may be rotated to a non-engaging position upon rotation of said shank beyond the limit permitted by said rotation limiting means.

8. The marine anchor according to claim 7, including;

fluke rotating means associated with each said flukes and said fluke shaft for initially positioning said flukes in proper engaging angle and assisting in the release of said flukes from engagement with a rearward and lifting motion upon rotation of said shank means beyond the limit permitted by said rotation limiting means.

9. The marine anchor according to claim 8, wherein; said fluke rotating means comprises a ring connected to each fluke and to said fluke shaft with the axis of said ring coinciding with the axis of said shaft.

10. The marine anchor according to claim 8, wherein; said fluke rotating means comprises a plurality of radially extending fluke rotator members connected to said fluke shaft and extending radially therefrom adjacent each fluke.

11. The marine anchor according to claim 7, wherein said rotation limiting means comprises;

guide members connected to each said fluke and located on each side respectively of said shank, and stop members extending between said guide members in the path of said shank to limit the rotational movement of said shank relative to the fluke shaft to an angle of from 60 to 90 degrees.

12. The marine anchor according to claim 7, wherein said rotation limiting means comprises;

cam means mounted on said fluke shaft between said flukes, said cam means including a cam surface surrounding the major portion of the circumference of said fluke shaft and an arcuately extending slotted portion, and release means operatively associated with said shank and said cam means, said release means having a holding position for engaging said slotted portion to limit the rotation of said shank relative to said fluke shaft the arcuate extent of said slotted portion when the anchor is in its engaging position and a release position for engaging said cam surface to permit said shank to be rotated beyond the limit determined by said slotted portion, whereby the anchor may be positioned for anchoring engagement in the opposite direction.

13. The marine anchor according to claim 12, wherein;

said shank means includes spaced shank members pivotally connected to said fluke shaft at their rearward ends adjacent said cam means and a release lever pivoted to their forward ends for attaching a line, said release means including a spring bias plunger for engaging said slotted portion and connector means extending between said release lever and said plunger for withdrawing said plunger upon rotation of the lever relative to said shank members.

14. The marine anchor according to claim 13, including;

sealing means carried by said fluke shaft and said shank members for enclosing said release means so as to prevent entry of jamming materials while allowing passage of water.

15. A fluke structure for an anchor comprising; a generally flat elongated body portion having a rearward end for connection to an anchor structure and a forward end for holding engagement, the forward end of said body portion including a pair of engaging points spaced equidistantly from the longitudinal centerline of the fluke, and the forward portions of the side edges of said fluke being inclined toward the centerline of the fluke.

16. The fluke structure according to claim 15, wherein; the forward portion of the side edges of said fluke are inclined toward the centerline at an angle of from 3 to 8 degrees.

17. The fluke structure according to claim 16, wherein; the distance along the rearward portion of the side edges from the point at which the incline begins to the rearward end is approximately equal to the width of the fluke.

18. The fluke structure according to claim 16, wherein; the angle of inclination is approximately 5 degrees.

19. The fluke structure according to claim 15, wherein; the angle between the forward portion of the side edges and the edge formed by a line extending from each point to the centerline is from 20 to 30 degrees.

20. The fluke structure according to claim 15, wherein; the angle between the forward portion of the side edges and the edge formed by a line extending from each point to the centerline is 24 degrees.

* * * * *